US005564633A

United States Patent [19]

Hardy et al.

[11] Patent Number: 5,564,633

[45] Date of Patent: Oct. 15, 1996

[54] FUEL INJECTION NOZZLE

[75] Inventors: Martin P. Hardy; John W. Stevens, both of Kent, England

[73] Assignee: Lucas Industries, Public Limited Company, England

[21] Appl. No.: 399,297

[22] Filed: Mar. 3, 1995

[30] Foreign Application Priority Data

Mar. 9, 1994 [GB] United Kingdom ..... 9404489

[51] Int. Cl.[6] ..... F02M 61/20

[52] U.S. Cl. ..... 239/533.2; 239/533.4; 239/600

[58] Field of Search ..... 239/533.3–533.12, 239/585.1–585.5, 600

[56] References Cited

U.S. PATENT DOCUMENTS 4,645,127 2/1987 Emory et al. ..... 239/600 X
4,749,131 6/1988 Katchka ..... 239/600 X
4,946,106 8/1990 Turchi et al. ..... 239/585.1
5,449,120 9/1995 Tani et al. ..... 239/600 X

FOREIGN PATENT DOCUMENTS 804116 11/1958 United Kingdom .

*Primary Examiner*—Kevin Weldon
*Attorney, Agent, or Firm*—Andrus, Sceales, Starke & Sawall

[57] ABSTRACT

The present invention embodies a fuel injector that takes up limited space when installed on the cylinder head of an associated engine. According to the invention in a fuel injection nozzle of the kind specified the wider portion of the nozzle body is provided with a slot which extends from the step toward the nozzle holder, the portion of the nozzle holder adjecent the nozzle body being provided with a slot. A chip member located in the slot secures the collar to the nozzle holder to retain the nozzle body relative to the nozzle holder.

5 Claims, 1 Drawing Sheet

FUEL INJECTION NOZZLE

This invention relates to a fuel injection nozzle for supplying fuel to a compression ignition internal combustion engine, the nozzle being of the kind comprising a stepped cylindrical nozzle body in which is located a fuel pressure actuated valve member and a cylindrical nozzle holder to which the nozzle body is secured, the nozzle holder including a fuel inlet passage which communicates with a fuel inlet and the nozzle body having a fuel supply passage communicating with the fuel inlet passage, a collar engaged with a step defined between a wider and a narrower portion of the nozzle body and means for securing the collar to the nozzle holder whereby the nozzle holder and nozzle body are held in assembled relationship.

Fuel injection nozzles of the aforesaid type are well known in the art and in the use of the nozzle it is accommodated within a bore formed in the cylinder head of the associated engine with the collar being urged into sealing engagement with a step formed in the wall of the bore, by some form of clamping device. In the known forms of fuel injection nozzle the collar is constructed as part of a cap nut which includes an integral hollow cylindrical skirt having a screw thread formation on its inner surface for engagement with a complementary thread formation on the nozzle holder. This means that for a given diameter of nozzle body, the overall diameter of the fuel injection nozzle is increased by at least twice the thickness of the skirt portion of the cap nut and the diameter of the bore to accommodate the nozzle must also be of an appropriate size.

The space available to locate the bore is limited and is becoming more so as the engine valve gear becomes more complex and as the cubic capacity of the engine is reduced. It is not easy to reduce the diameter of the nozzle body because of the tendency to increase the operating stresses in the materials. At the present time the smallest nozzle body has a diameter of 14.3 mm so that the overall diameter of the skirt portion of the cap nut may be 17.00 mm and the diameter of the bore 17.15 mm.

The object of the present invention is to provide a fuel injection nozzle of the kind specified in a simple and convenient form.

According to the invention in a fuel injection nozzle of the kind specified the wider portion of the nozzle body is provided with a slot which extends from said step towards the nozzle holder, the portion of the nozzle holder adjacent the nozzle body being provided with a complementary slot, the fuel injection nozzle further including a clip member which is located in said slot and which secures the collar to the nozzle holder thereby to retain the nozzle body relative to the nozzle holder.

An example of a fuel injection nozzle in accordance with the invention will now be described with reference to the accompanying drawings in which.

Figure 1:
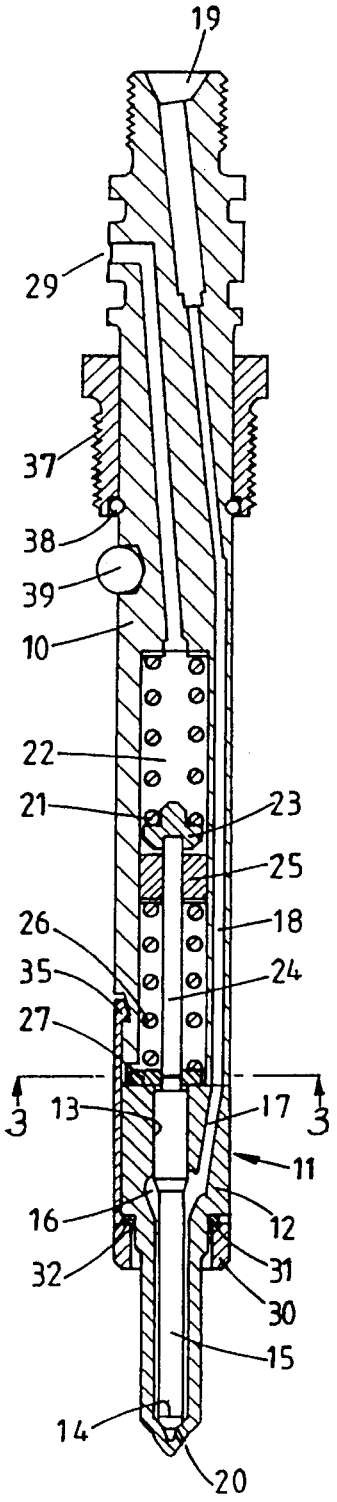
FIG. 1 is a cross-sectional side elevation of the nozzle.
Figure 2:
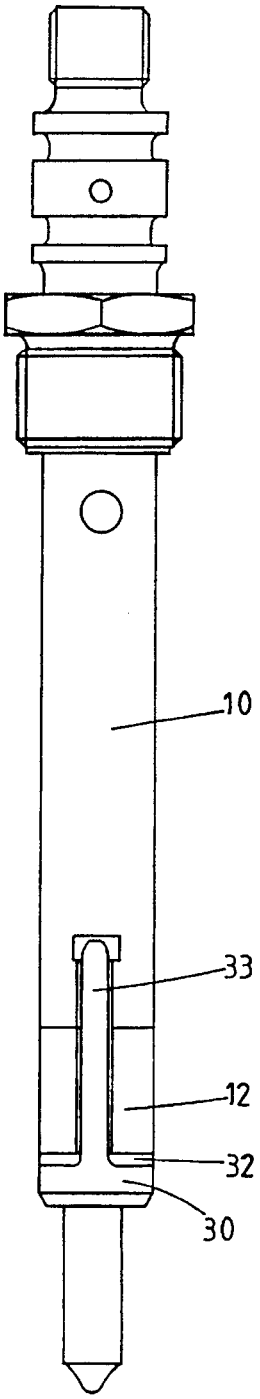
FIG. 2 is a side elevation of the nozzle taken at right angles to FIG. 1.

Referring to the drawings the fuel injection nozzle comprises a cylindrical holder 10 to one end of which is secured a stepped nozzle body 11. As will be seen from the drawings the wider portion 12 of the nozzle body lies adjacent the end of the holder and the holder and the wider portion of the nozzle body are of the same diameter.

Formed in the nozzle body is a bore 13 extending from the wider end of the body and terminating in a seating 14 and slidable in the bore is a valve member 15. Intermediate the ends of the bore 13 there is formed an enlargement 16 which communicates by way of a fuel supply passage 17 with a fuel inlet passage 18 formed in the nozzle holder and which communicates with a fuel inlet 19 formed at the end of the nozzle holder remote from the nozzle body. The portion of the valve member 15 which lies intermediate the enlargement 16 and the seating 14 is of reduced diameter to define an annular fuel flow passage leading downstream of the seating into a sac volume from which extend a plurality of outlet orifices 20.

The valve member is urged into engagement with the seating by means of a first coiled compression spring 21 which is located in the end of a chamber 22 extending within the nozzle holder. One end of the spring is in engagement with the adjacent end wall of the chamber and the other end of the spring is mounted upon a spring abutment 23 and the spring force is transmitted to the valve member by means of a push rod 24 which is located within a recess in the spring abutment and which bears against a reduced end portion of the valve member.

Figure 3:
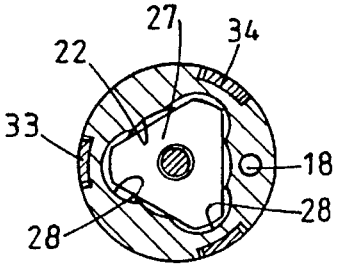
FIG. 3 is a cross-section on the line 3—3 of FIG. 1.

The push rod 24 passes through and is guided by the wall of an aperture which is formed in a further spring abutment 25 which is secured by means not shown in the chamber 22. The abutment 25 is engaged by a second coiled compression spring 26 and this at its other end, bears against a plate 27 which as seen in FIG. 3, has a generally triangular shape with the apices rounded. The plate under the action of the spring 26 bears against the adjacent end surface of the nozzle body and the movement of the plate 27 away from the nozzle body which takes place during the operation of the nozzle and as will be described, is limited by the engagement of the apical portions of the plate with the base walls of respective part recesses 28 which are formed in the end face of the nozzle holder. In addition, in the closed position of the valve member as shown in FIG. 1, a small clearance exists between the main portion of the valve member and the plate 27.

The chamber 22 communicates with a drain outlet 29 formed in the wall of the holder adjacent the inlet 19 and in use, the inlet 19 is connected via a small bore pipe, to an outlet of a fuel injection pump. The nozzle arrangement as described is of the two stage lift type and in operation, when fuel under pressure is supplied to the inlet, the fuel pressure acting on the valve member generates a force which opposes the action of the spring 21. When this force is sufficient to overcome the force exerted by the spring 21, the valve member is lifted from its seating by an amount to take up the clearance between the valve member and the plate 27. Fuel can flow through the outlet orifices 20 at a restricted rate. As the fuel pressure at the inlet continues to increase, the force acting on the valve member due to the pressure of fuel increases and eventually the valve member will lift a further distance from its seating against the action of both springs. The extent of movement is limited by the engagement of the apical portions of the plate 27 with the base walls of the recesses 28. With the valve member in the fully open position the flow of fuel through the outlet orifices takes place at a higher rate. When the supply of fuel to the inlet ceases the valve member moves to the closed position as shown in the drawings.

The conventional practice is to secure the nozzle body to the nozzle holder by means of a cap nut but as explained earlier in the specification the provision of the cap nut means that the overall diameter of the portion of the nozzle which is located in the bore in the cylinder head of the engine, is increased.

In order to secure the nozzle body to the nozzle holder there is provided an annular collar 30 between which and a step 31 defined between the narrower and wider portions of the nozzle body is located a spring washer 32. Integrally formed with the collar are in the particular example, three arcuate clips 33 and these are located in recesses 34 formed in the wider portion 12 of the nozzle body and in the adjacent portion of the nozzle holder. The depths of the recesses and the thickness of the clips are such that the outer surfaces of the clips when the injection nozzle is assembled, lie flush with the adjacent surfaces of the nozzle body and the holder. At the ends of the clips 33 remote from the collar inwardly extending projections 35 are formed which are shaped to engage against locking surfaces formed at the ends of the recesses in the nozzle holder. The arrangement is such that when the projections are engaged with the surfaces the spring washer 32 is flattened to a limited extent and this provides a force which biases the nozzle body into engagement with the end of the holder in order to prevent the ingress of dirt during transport. This force however is not sufficient to guarantee that a fuel tight seal will be formed between the surfaces of the nozzle holder and the nozzle body. When however the fuel injection nozzle is located in the bore with the collar 30 engaging a step defined in the bore, and a clamping force is applied to the nozzle holder, the force acting between the nozzle holder and the nozzle body will be increased by a sufficient amount to form a fuel tight seal thereby to prevent leakage of fuel.

It will be noted that the clips 33 and the recesses 34 in which they are located, are orientated in the same way as the recesses 28. Moreover, the passage 17 and also the passage 18 are positioned where the wall thickness of the nozzle body and the holder is at a maximum.

The clamping of the fuel injection nozzle within the bore can be achieved in any convenient manner but in the example shown, a screw threaded collar 37 is provided for engagement with a screw threaded portion of the bore in the cylinder head. The collar 37 engages with a circlip 38 located within a groove in the nozzle holder. Conveniently the holder is provided with a locating projection which is in the form of a ball 39 accommodated within a recess formed in the nozzle holder. When the collar 37 is tightened the spring washer 32 will undergo further compression and therefore an adequate axial clearance must be provided for the projections 35 on the clips 33.

Although it is convenient to form the clips as an integral part of the collar 30 they may be separately formed and although as described the fuel injection nozzle is of the two stage lift type, it will be appreciated that the invention may be applied to a nozzle of the single stage lift type.

We claim:

1. A fuel injection nozzle for supplying fuel to a compression ignition engine and comprising a stepped cylindrical nozzle body in which is located a fuel pressure actuated valve member, a cylindrical nozzle holder to which the nozzle body is secured, the nozzle holder including a fuel inlet passage which communicates with a fuel inlet and with a fuel supply passage in the nozzle body, a collar engaged with a step defined between a wider and a narrower portion of the nozzle body, means for securing the collar to the nozzle holder, the nozzle body being provided with a recess which extends from said step towards the nozzle holder, the nozzle holder being provided with a complementary recess, and said means comprising a clip which is located in said recess and said complementary recess which secures the collar to the nozzle holder thereby retaining the nozzle body relative to the nozzle holder.

2. A nozzle according to claim 1, in which the recess and clip are of arcuate form.

3. A nozzle according to claim 1, in which a spring washer is interposed between the collar and the step, the spring washer acting to maintain the nozzle holder and nozzle body in engagement during transport.

4. A nozzle according to claim 3, in which the clip is formed integrally with the collar and at its end remote from the collar is provided with an inwardly extending projection for engagement with a locking surface formed adjacent the end of the complementary recess in the nozzle holder, said complementary recess extending beyond the locking surface to accommodate the projection and to allow relative movement between the projection and nozzle holder when the spring washer is flattened when the nozzle is secured within a bore in the engine.

5. A nozzle according to claim 4, in which the collar is provided with at least three clips, said clips being equiangularly spaced about the collar.

* * * * *